United States Patent [19]

Sinha

[11] Patent Number: 4,661,153

[45] Date of Patent: Apr. 28, 1987

[54] REFRACTORY POROUS PLUG

[75] Inventor: Uday K. Sinha, Carrollton, Ga.

[73] Assignee: Southwire Company, Carrollton, Ga.

[21] Appl. No.: 510,055

[22] Filed: Jul. 1, 1983

[51] Int. Cl.[4] ..... C22B 15/14

[52] U.S. Cl. ..... 75/76; 266/46; 266/220; 266/270

[58] Field of Search ..... 75/76; 266/46, 47, 220, 266/270

[56] References Cited

U.S. PATENT DOCUMENTS

| | | | |
|---|---|---|---|
| 2,811,346 | 10/1957 | Spire | 266/220 |
| 3,343,829 | 9/1967 | Coates | 266/220 |
| 3,850,620 | 11/1974 | Themelis et al. | 75/76 |
| 4,326,701 | 4/1982 | Hayden, Jr. et al. | 266/270 |
| 4,435,211 | 3/1984 | Schwartz et al. | 266/47 |

FOREIGN PATENT DOCUMENTS

| | | | |
|---|---|---|---|
| 1175226 | 12/1969 | United Kingdom | 266/220 |
| 1192844 | 5/1970 | United Kingdom | 266/220 |
| 0524388 | 1/1978 | U.S.S.R. | 266/270 |

*Primary Examiner*—L. Dewayne Rutledge
*Assistant Examiner*—Robert L. McDowell
*Attorney, Agent, or Firm*—Herbert M. Hanegan; Stanley L. Tate

[57] ABSTRACT

In an in-line refining vessel (50) having submerged porous plugs (20) for bubbling oxygen through the molten metal, a shroud device (52) to circulate nitrogen around the porous plug (20) and oxygen supply pipe (25).

4 Claims, 2 Drawing Figures

REFRACTORY POROUS PLUG

TECHNICAL FIELD

This invention relates to the metallurgical arts, and more particularly to copper refining metallurgy. Specifically, this invention relates to improvements in equipment for the oxygenation phase of in-line refining of copper metal.

BACKGROUND ART

Copper produced by smelting is frequently electrorefined. For this reason, the molten copper product must be suitable for casting anodes. This makes it necessary to refine the copper to remove substantial quantities of dissolved sulphur and oxygen in order to cast desirable anodes. If the metal were cast directly, the high level of sulphur (typically 0.05%) and dissolved oxygen (typically 0.5%) would combine to form $SO_2$ blisters in the cast metal. The purpose of in-line refining, as practiced with the present invention, is to remove sulphur from the molten copper. This is done in two steps: "blowing" and "poling". Blowing is the oxygenating step, wherein the sulphur is oxidized (to $SO_2$), lowering the sulphur level (to typically 0.003%) in the molten copper. Typically, an oxygen content of 0.4% to 0.6% is required in the molten copper, as a good thermodymic condition for facilitating oxidation of the impurities. Poling—introducing hydrocarbon into the melt—reduces the oxygen content and minimizes the formation of copper oxide during solidification.

The present invention is directed to improvements in apparatus for the oxygenation of molten copper. In one process for in-line copper refining, molten copper is subjected to oxygenation during the refining process. One method of oxygenating the copper is by passing a stream of oxygen through a porous plug into the molten metal. An experimental arrangement was undertaken to determine the feasibility of this procedure in certain in-line refining procedures. In the procedure, a porous plug was used to bubble oxygen into a molten metal, which metal was to be moved past the porous plug by gravity. However, a high-temperature reaction between the oxygen and steel tubing and porous plug cover portions occurred, melting the steel. The steel industry equipment, even though developed for use with much higher molten metal temperatures, failed at molten copper temperatures because the steel components melted.

DISCLOSURE OF THE INVENTION

The present invention protects the porous plug steel components from melting due to exposure to oxygen at high temperatures by circulating a relatively cool inert gas, such as nitrogen (which may be cooled if needed) around the steel supply pipe, thus reducing the temperature. In the event that it is desired, the gas may be cooled and recirculated to reduce operating expense. The porous plug supply pipe and plug sheath are enclosed and cooled nitrogen is circulated therearound to keep the steel part temperatures below that at which the steel reacts with the oxygen. A refractory material may also be used to line the inside of the steel shell of the porous plug to keep it separated from the pure oxygen.

For these and other reasons which may become apparent hereinafter, this invention therefore contemplates the use of cooled nitrogen circulating around the porous plug to maintain the temperature thereof low enough to prevent melting of steel components due to reaction with oxygen.

An object of this invention is to extend the life of porous plugs in molten copper oxidation vessels.

Yet another object of the present invention is to eliminate oxidation vessel down time and maintenance expenses due to the need for frequent porous plug replacement.

Still another object of this invention is to provide a convenient means to introduce oxygen into molten copper for carrying out in-line refining.

BRIEF DESCRIPTION OF THE DRAWINGS

Other features and advantages of the invention disclosed herein will be apparent upon examination of the drawing figures forming a part hereof, in which the protective shroud for porous plugs is shown in detail.

BEST MODE FOR CARRYING OUT THE INVENTION

Figure 1:
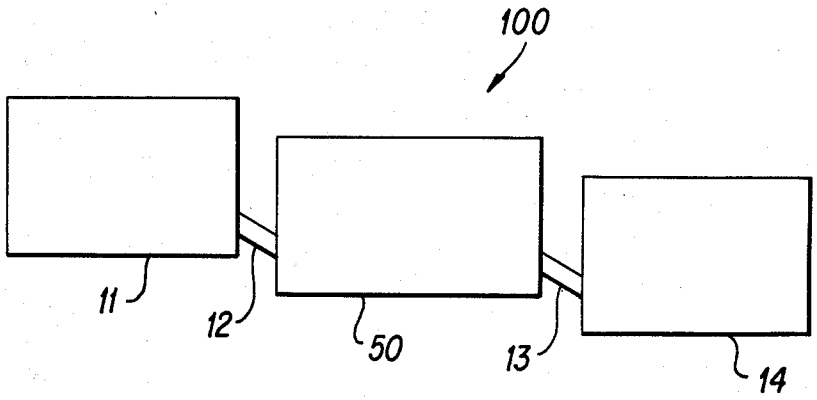
FIG. 1 shows the location of the oxygenation vessel in its in-line refining operation.

The present invention comprises improvements in an oxygenation vessel forming a part of an in-line refining operation 100, FIG. 1. The oxygenation vessel 50 is located along the in-line refining molten metal flow path between the furnace 11 and the reduction vessel 14. A first launder 12 conveys the molten metal to the oxygenation vessel 50, and a second launder 13 conveys the molten metal from the oxygenation vessel to the reduction vessel 14.

Figure 2:
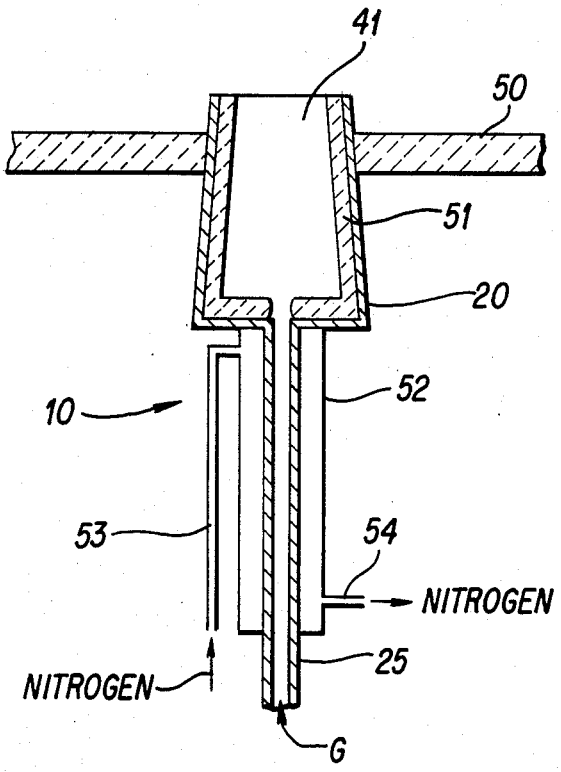
FIG. 2 is a cross section of a single porous plug apparatus according to the invention.

Turning now to FIG. 2, there is shown a cutaway view of the oxygenation vessel 50 revealing the present invention 10. At least one molten copper impervious porous plug 20 is attached to the bottom of the oxygenating vessel 50. The porous plug 20 is supplied with a gas mixture G (which may be oxygen) and cooled nitrogen is circulated therearound in a circulating shroud 52 via supply pipes 53, 54 which lowers the temperature thereof.

The vessel bottom 50 may contain one or more apertures through which one or more corresponding porous plug are inserted. Gas G is passed through the porous plug (s) and through the porous material 41 filling the plug. Cooled nitrogen is circulated around the supply pipe, and may be circulated around the porous plug shell, to avoid melting of steel components.

When it is desired to bubble oxygen or air through the molten metal into the oxygenation vessel 50, a remote valve is opened and nitrogen permitted to flow through pipe 53 into shroud 52 and be exhausted via pipe 54. Oxygen is then permitted to flow (by a remote valve, not shown) up through pipe 25 and into the porous plug 41.

It is disclosed that the porous plug steel shell may be lined with a gas impermeable refractory liner 51 to further protect the steel shell.

What is claimed is:

1. The method of oxygenation of molten smelter copper containing slag and impurities comprising:

a. flowing molten smelter copper through an oxygenation vessel means, b. flowing oxygen into the oxygenation vessel via a porous plug means, c. passing a cooled inert cooling gas around the external portions of the porous plug within a shroud, d. exhausting said cooling gas from said shroud, and e. recirculating the inert cooling gas for subsequent reuse.

2. The method of claim 1 wherein the gas is nitrogen.

3. The method of oxygenation of molten smelter copper containing slag and impurities comprising:

a. flowing molten smelter copper through an oxygenation vessel, b. first passing a cooled inert cooling gas around the external portions of a porous plug located in said oxygenated vessel within a shroud, c. exhausting said inert cooling gas from said shroud and recirculating said inert cooling gas for subsequent cooling and reuse, and d. flowing oxygen into the oxygenation vessel via said porous plug.

4. The method of claim 3 including cooling the gas.

* * * * *